US005609416A

United States Patent [19]

Duckworth

[11] Patent Number: 5,609,416

[45] Date of Patent: Mar. 11, 1997

[54] PORTABLE CONTINUAL MIXER

[76] Inventor: Donald L. Duckworth, 702 Columbia St., NE., Roanoke, Va. 24016

[21] Appl. No.: 657,956

[22] Filed: Jun. 4, 1996

[51] Int. Cl.[6] ..... B28C 7/14; B01F 15/02

[52] U.S. Cl. ..... 366/34; 366/35; 366/38; 366/40; 366/64; 366/156.1; 366/158.1; 366/297

[58] Field of Search ..... 366/8, 10, 33, 366/34, 35, 38, 40, 64, 156, 157, 158, 167, 168, 177, 181, 194, 195, 196, 318, 322, 156.1, 158.1, 331, 300, 297, 298, 299

[56] References Cited

U.S. PATENT DOCUMENTS

| | | | |
|---|---|---|---|
| 1,753,716 | 4/1930 | Owen . | |
| 2,276,237 | 3/1942 | Lowry . | |
| 2,296,505 | 9/1942 | Diehl . | |
| 2,298,258 | 10/1942 | Ziler . | |
| 3,469,824 | 9/1969 | Futty et al. . | |
| 3,730,487 | 5/1973 | Lund | 366/300 |
| 4,223,996 | 9/1980 | Mathis et al. . | |
| 4,298,288 | 11/1981 | Weisbrod . | |
| 4,566,799 | 1/1986 | Ito et al. . | |
| 5,213,414 | 5/1993 | Richard et al. . | |
| 5,354,127 | 10/1994 | Zotto | 366/298 |

FOREIGN PATENT DOCUMENTS

3142053A1 5/1985 Germany .

*Primary Examiner*—Robert W. Jenkins
*Attorney, Agent, or Firm*—Terrance L. Siemens

[57] ABSTRACT

A small batch mixer particularly suited for preparing small quantities of mixture blends dry powdered material with an aggregate and a liquid. The ingredients may be cement, sand, and water. The batch mixer has two screw augers. The first auger feeds dry mix into an elongated mixing chamber of constant diameter. The second auger mixes the dry and liquid mix constituents, and conducts blended mixture to a discharge port located at the end of the elongated mixing chamber. The blade of the second auger is formed in three sections. In respective order, these sections include a first section wherein the blade is configured as a screw auger; a second section wherein the blade has intermittent gaps, thereby forming paddles pitched to urge the mixture onward to the third section; and a third section which, like the first section, includes a blade configured as a screw auger. The liquid is metered by a valve controlled in accordance with the feed rate of the solid constituents. A predetermined proportion of dry and liquid constituents is thus maintained. The second auger mixes and blends dry and liquid constituents, and discharges a final blended mixture. The housing of the mixing chamber is longitudinally split, so that it is readily opened and quickly cleaned after operation is complete.

9 Claims, 2 Drawing Sheets

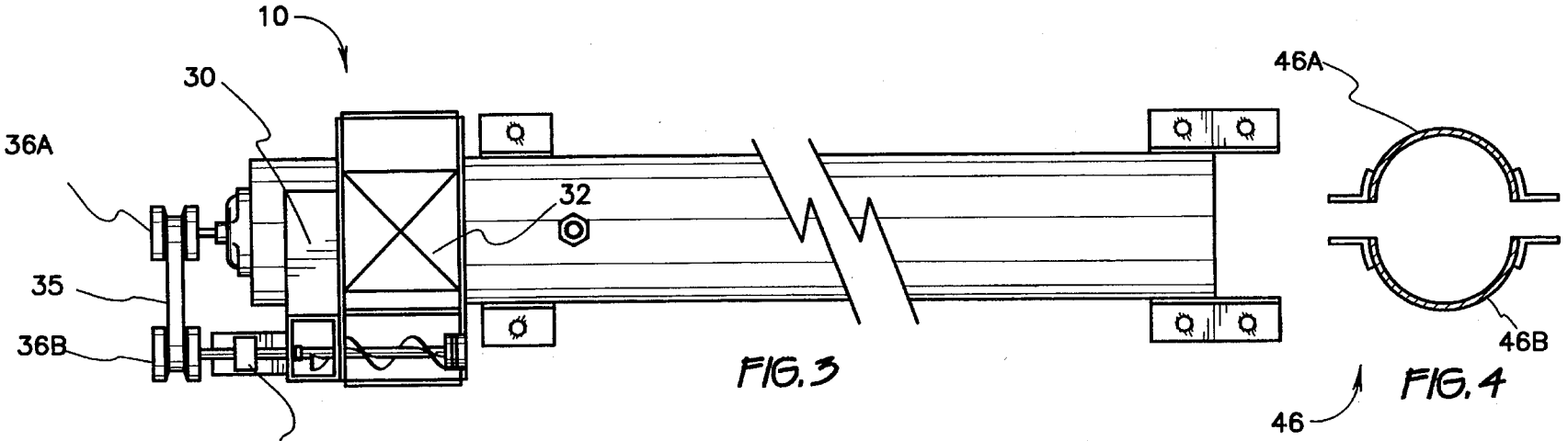
FIG. 4
FIG. 3
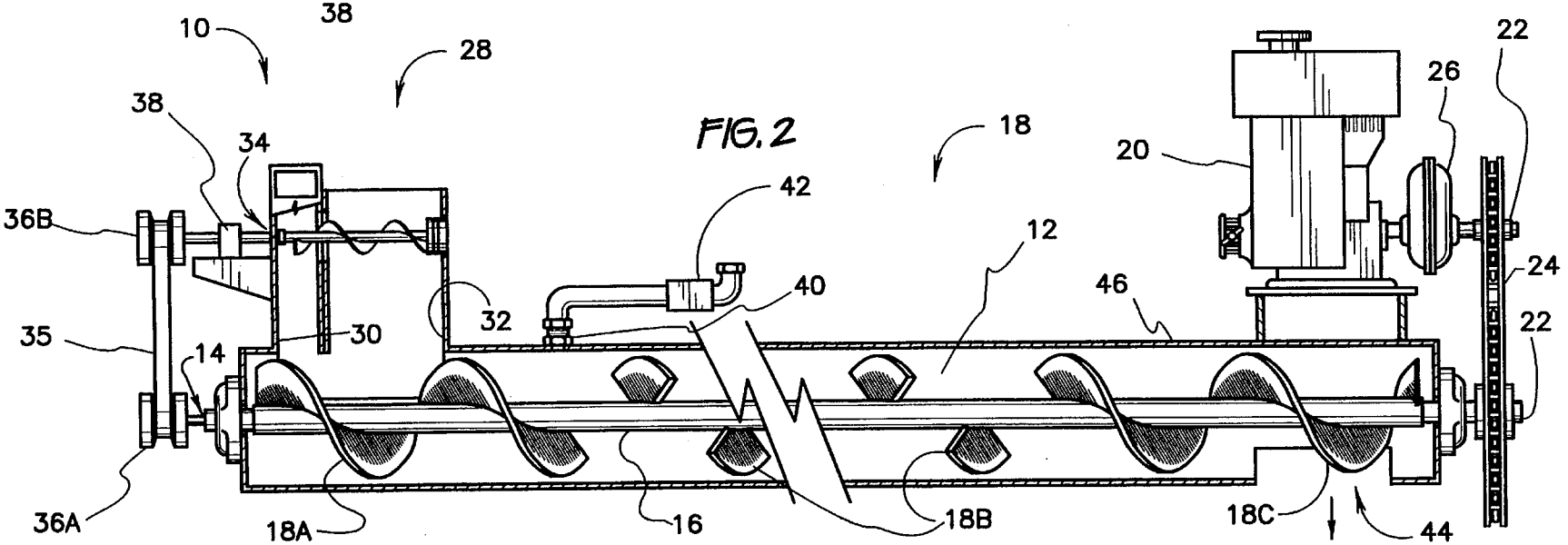
FIG. 2

PORTABLE CONTINUAL MIXER

The present invention is an improvement to my U.S. Pat. No. 5,470,147, issued Nov. 28, 1995, the disclosure which is hereby incorporated by reference.

BACKGROUND OF THE INVENTION

1. Field of the Invention

This invention relates to a mixer capable of mixing and dispensing relatively small quantities of cement and concrete in a continuous manner. As such it is generally applicable to the many fields of construction that utilize concrete. More generally the invention could find use in any field requiring the mixing of one or more aggregate or powdered solids with a fluid to produce a slurry or mixed composite in a continuous manner.

It should be noted that although a principal application of the invention is to mixing concrete, cement, and mortar, the principles embodied herein are suitable for mixing any type of powdered or granular solid with a liquid. Examples include preparing batter, ceramic mixes such as slip, plaster, and paint; mixing resins and curing or hardening agents; and conditioning soil, as for planting. These are but several examples of possible applications.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

Mixers for preparing mixes of solids in powdered or aggregate form and a liquid are old. Such mixers are typically employed to prepare batter and dough for baking, concrete and cement for building, resins for manufacturing, and similar mixtures wherein two or more raw materials are blended to prepare a homogeneous material for ultimate use. Mixers generally include a receptacle to hold the mixture, a beater or agitator to blend the constituent materials, and a chute or analogous structure for dispensing the final mixture.

U.S. Pat. No. 4,566,799, issued to Yasuro Ito et al. on Jan. 28, 1986, describes a power driven agitator and a power driven feeder. Fine aggregate and coarse aggregate are fed into the mixing chamber by a belt conveyor, rather than by augers, as provided in the present invention. Also, materials are delivered into a trough open at the top at plural points along the trough in Ito et al. By contrast, in the present invention, all solids are introduced at a single feed point. In the present invention, a housing corresponding to the trough of Ito et al. is enclosed, although split for ready access to the interior thereof. The device of Ito et al. lacks the drive and single motor of the present invention.

U.S. Pat. No. 1,753,716, issued to Jack M. Owen on Apr. 8, 1930, describes a mixer for dry cement comprising a mixing chamber supplied by a hopper at one end and having a delivery chute at the other end. The mixing chamber has an auger formed in two sections. The first section has a full helical screw for propelling constituent materials towards the second section, where paddles blend or mix the constituents. By contrast, the present invention provides three sections, the last being an auxiliary propelling section. Owen also lacks the drive system of the present invention.

U.S. Pat. No. 3,469,824, issued to Robert C. Futty et al. on Sep. 30, 1969, describes a mixer having a single auger. The blade is different from that of the present invention. Also, there is no separate feed auger for introducing constituent materials into the mixer. Hence, the drive arrangement necessarily differs from that of the present invention.

U.S. Pat. No. 4,298,288, issued to Alvin J. Weisbrod on Nov. 3, 1981, describes a wheeled, mobile mixing apparatus having a compound mixing chamber, rather than the single, linear chamber of the present invention. This arrangement lacks the auger having blades of different character, as found in the present invention. Constituent solids are introduced at several inlet ports into the mixing chamber in Weisbrod, rather than at the single inlet of the present invention. Weisbrod employs many motors to accomplish his various functions, whereas the present invention has but one motor.

U.S. Pat. No. 5,213,414, issued to Bennet M. Richard et al. on May 25, 1993, describes a mixer having a single, linear mixing chamber. However, unlike the present invention, Richard et al. provides a a mixing auger lacking a blade exhibiting different types, as seen in the present invention. Also, Richard et al. provide a feed auger having a dedicated motor.

U.S. Pat. No. 4,223,996, issued to Paul Mathis et al. on Sep. 23, 1980, describes a mixer having a single feed auger which urges mix material into a mixing chamber and then to a discharge port. The inlet chamber of Mathis et al. is of variable diameter, and small quantities of cement mix or sand could become trapped, and removed only upon cleaning the mixer. By contrast, the mixing chamber of the instant invention has a constant diameter, which avoids entrapping small quantities of mixed material.

German Patent Document No. 31 42-053 A1, by Wachter et al., dated May, 1985, describes a similar mixer with abruptly changing chamber diameters. By contrast, the mixing chamber of the instant invention has a constant diameter for promoting undisturbed migration of mixed material and for ease of cleaning.

A mixer comprising paddles mounted on a rotating shaft is seen in U.S. Pat. No. 2,298,258, issued to William J. Ziler on Oct. 6, 1942. This mixing apparatus is located in a chamber dedicated exclusively to mixing, and action of the paddles pushes the mixed product towards another chamber. The mix is drawn from this second chamber for dispensing through a pipe.

Another arrangement wherein paddles agitate the constituent ingredients into a homogeneous, blended mix is seen in U.S. Pat No. 2,276,237, issued to Ronald P. Lowry on Mar. 10, 1942. In Lowry's device, dry, powdered cement is gravity fed from a hopper into a conveyor including a screw auger, and propelled towards a vertical conduit. Water is arranged to be introduced to the dry mix in a conduit forming an annulus surrounding the vertical conduit. Water is metered in Lowry's device by a metering pump which is driven by fixed connection to the screw auger shaft.

The dry mix and water are discharged into a mixing chamber having paddles fixed to a rotating shaft. The dry and wet constituents are mixed as they migrate toward the end of this mixing chamber. The final, prepared mix is discharged through an opening formed in the floor of the mixing chamber at the end thereof, and held in a storage tank. As in the case of Ziler, a pipe draws the mix from this storage tank for dispensation and use.

U.S. Pat. No. 2,296,505, issued to Kent B. Diehl on Sep. 22, 1942, describes a trailer mounted mixer having a single shaft screw auger mixer. Dry constituents are loaded into a hopper which discharges into the screw auger housing. The auger propels the dry mix towards the end of the housing, whereupon the mix drops through an opening formed in the floor into a discharge conduit. This discharge conduit has a first vertical leg, a second horizontal leg, and a final vertical leg. Water is metered by an adjustable valve, and the metered flow thereof is introduced into the discharge conduit at the elbow between the first vertical leg and the second horizontal leg. It should be noted that the screw auger functions purely as a conveyor, and no mechanical agitating apparatus is provided to blend the water and dry mix after these two materials have been fed into a common conduit or chamber.

None of the above inventions and patents, taken either singly or in combination, is seen to disclose the instant invention as claimed.

SUMMARY OF THE INVENTION

The present invention provides a mixer having a single mixing and conveying chamber of constant cross sectional dimension, and having a singular rotating shaft. The screw auger incorporating this shaft serves as both a conveyor and a mixer. This is accomplished by modifying the auger helical blade such that a central portion has portions removed. The pattern of partial blade alternating with gaps serves as a mixer, while continuing to propel the mixture through the chamber. The central portion is followed by another portion of full blade construction, so that the mixed fluent mass is efficiently conducted to the end of the chamber.

Thus, the auger helical blade is characterized by having three distinctive sections, each configured differently from its neighbor. A first section has a conventional screw configuration for conveying. The second section comprises separate paddles, for mixing. The pitch of these paddles is essentially similar to that of the screw, so that the material being mixed will continue to migrate in the direction of flow caused by the first section. The final section also comprises a screw for conveying.

The fluent solid and water are separately introduced into the mixing chamber. Each is fed in proportion to the other. A first screw conveyor driven by a motor is provided which meters dry mix into the chute. The mix is discharged, as described above, into the mixing chamber at the first, conveying section thereof. Water is introduced into the mixing chamber at the point at which the auger blade makes transition to its second section. The water is metered by a simple hand operated faucet valve. Optionally, the water may be metered by a control valve which is opened in proportion to the speed of the dry mix feed auger.

Water and dry mix are substantially blended in the mixing chamber at the second section having paddles, and pass to the third section for discharge.

A discharge port is formed in the bottom and at the end of the mixing chamber, and the mixture is ready for use immediately upon discharge.

An important element in the invention, apart from the aforementioned modification to the auger blade, is the provision of a single motor for driving both the main mixing auger and the dry mix feed auger. The advantages of having a single motor are to decrease the cost of making the invention. Also, the two augers may be driven at predetermined speed ratios by a suitable drive. In the preferred embodiment, one auger is driven by a belt and pulley arrangement from the other auger.

Another advantageous feature is that the housing of the main mixing and conveying chamber is longitudinally split. This enables easy washing after concrete mixing has been completed.

The novel arrangement is capable of preparing limited quantities of concrete, so that there is little waste.

Accordingly, it is one object of the invention to provide a mixer which can mix and dispense small batches with little or no waste.

It is a second object of the invention to meter solid, powdered material and a liquid in predetermined proportion.

It is another object of the invention to operate the feed auger at a predetermined speed fixed in relation to the operating speed of the mixing auger.

It is a further object of the invention to provide a mixing chamber of constant cross sectional diameter.

It is an additional object of the invention to provide a mixing chamber housing which is readily opened, as for cleaning.

Yet another object of the invention is to provide a single drive for operating both the feed auger and the mixing auger.

Still another object of the invention is to provide a portable, continuously operating mixer.

A still further object of the invention is to power the mixing auger by a small internal combustion engine, and to drive the feed auger from the mixing auger by a belt and pulley arrangement.

Yet another object of the invention is to reduce the output speed of the internal combustion engine, thereby driving the mixing auger at a reduced speed with respect to the internal combustion engine.

Still another object of the invention is to operate both mixing auger and feed auger from a single motor.

It is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 2 is a diagrammatic, side elevation view of the novel mixer, shown partly in cross section.

FIG. 3 is a diagrammatic, top plan view of the novel mixer.

FIG. 4 is a cross sectional detail view of the mixing chamber housing.

Similar reference characters denote corresponding features consistently throughout the attached drawings.

DETAILED DESCRIPTION OF THE PREFERRED EMBODIMENTS

Figure 1:
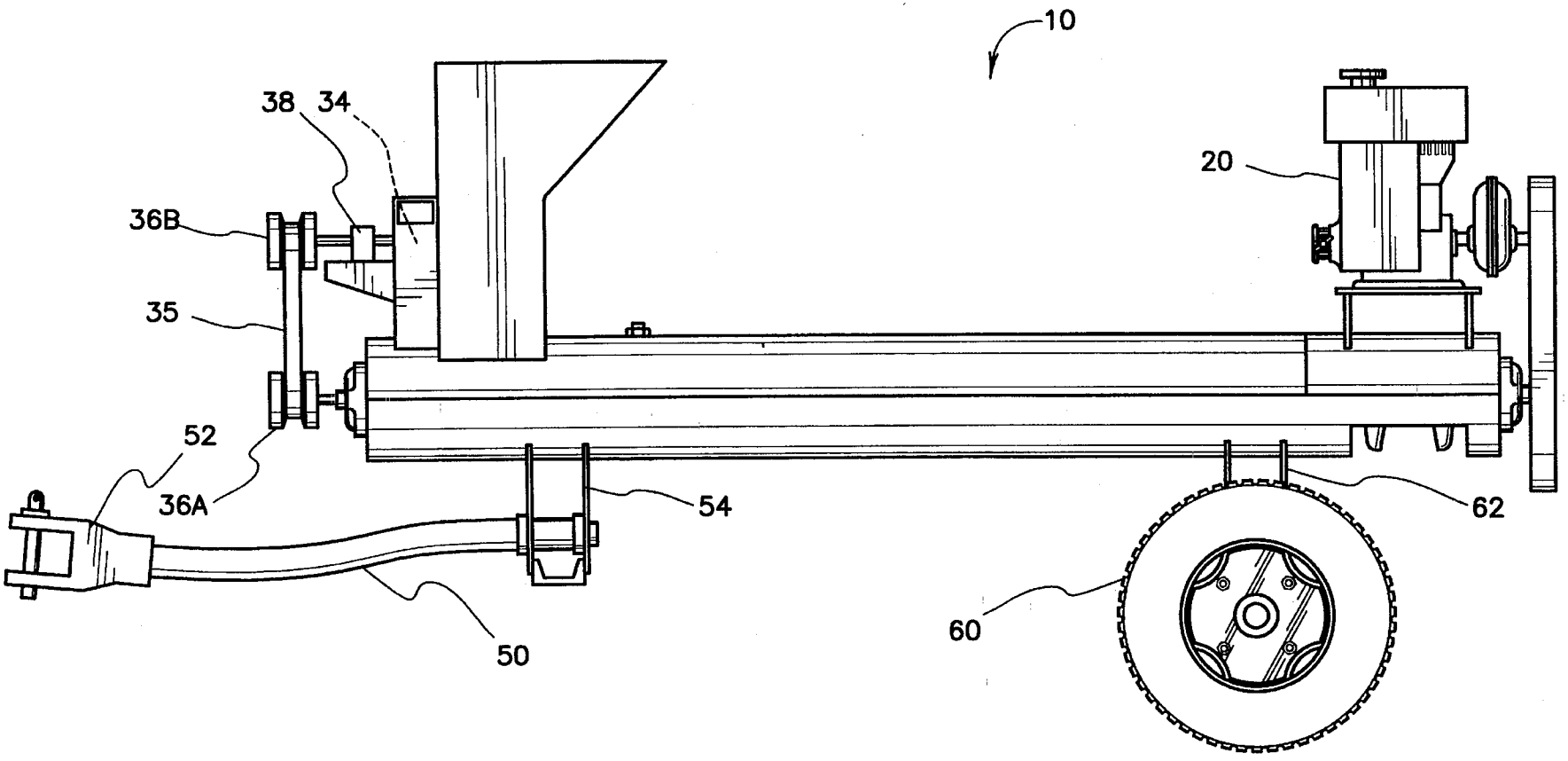
FIG. 1 is a side elevational view of the overall invention adapted as a mobile apparatus.

FIG. 1 is an environmental side view of the cement mixer of the instant invention indicated generally at 10. The preferred embodiment shows the mixer mounted on wheels 60 by running gear 62. Wheels 60 and running gear 62 are placed somewhat near the longitudinal center of gravity of the overall unloaded unit so as to provide balance for towing. Towing is accomplished by tongue 50 having a hitch unit 52 near the front and mounting means 54 near the rear of tongue 50. Details of the hitch and tow tongue mounting means are conventional and not further described here. Power is provided for operating the unit by internal combustion engine 20, described more fully later.

As seen in FIG. 2, the novel cement mixer 10 is characterized by an elongated main mixing chamber 12. Mixing chamber 12 has a constant diameter, which avoids entrapping small quantities of mixed cement, or constituents. By contrast, the inlet chamber of Mathis et al. '966 is of variable diameter, and small quantities of cement mix or sand could become trapped, and would be removed only upon cleaning the mixer.

Returning to novel mixer 10, a main auger 14 passes through mixing chamber 12. Main auger 14 includes a central shaft 16 and a blade 18. Blade 18 is divided into three sections 18A, 18B, and 18C. In a first section 18A, the blade describes a continuous helix about shaft 16. This portion 18A of blade 18 acts as a conveyor, propelling fluent solids to the right, as seen in this Figure.

In the second portion, the blade is partially cut away, so that the remaining parts describe paddles 18B. Paddles 18B effectively mix the powdered constituents and a liquid, which will be further described hereinafter. As the pitch of portion 18A is maintained in paddles 18B, paddles 18B also urge the fluent mass to the right.

The third section 18C of the blade is configured similarly to first section 18A. The fully mixed constituents are urged to the right thereby.

At the right of this Figure, a single cylinder internal combustion engine 20 is mounted, and drives shaft 16 through an arrangement of sprockets 22 and chain 24. Engine 20 is of any suitable type typically provided for operating small appliances, such as lawn mowers. A geared speed reducer 26 enables auger 14 to turn at a low speed, while engine 20 operates efficiently at a higher speed.

At the left, a hopper 28 is provided for supplying powdered or fluent solids into mixing chamber 12. Hopper 28 includes two chutes 30,32. The first chute 30 is relatively small, and communicates with a feed auger 34 for feeding cement into chute 30.

Feed auger 34 is driven from main auger 14 by pulleys 36A and 36B connected by a belt 35. Feed auger 34 is connected to pulley 36B by extension of its shaft 34A to a length enabling alignment of pulley 36B in the same vertical plane as pulley 36A. Consequent elongation of shaft 34A is accommodated by pillow block and bearing assembly 38.

Larger chute 32 does not have a powered feed device. It opens to mixing chamber 12, and is employed to feed aggregates such as sand and gravel into the cement mix. Chute 32 is fully charged with sand and gravel. These materials are gradually drawn into mixing chamber 12 by rotation of main or mixing auger 14.

Water, or any liquid appropriate for the mixture being produced, is introduced into mixing chamber 12 at a fitting 40. In the preferred embodiment the water flow is manually controlled as by any conventional water tap valve. As the proportion of water to cement mix is critical, it is envisioned this proportion could be maintained by linking the speed of pulleys 36A and 36B to a liquid metering device 42 controlling the rate of water feed. This is accomplished in any suitable way.

In one embodiment, device 42 may be a water pump which is connected to any rotatably driven component, such as chain 24, auger 14 or 34, or is independently driven. Alternatively, device 42 may be a variable position valve linked to the operating speed of the rotatably driven components. Still other arrangements may be employed to maintain the proportion of cement mix to water.

Mixed constituents are continually urged to the right of mixing chamber 12 by the various sections of blade 18. A discharge opening 44 is formed at the bottom of housing 46 enclosing mixing chamber 12. Mixed cement, concrete, mortar, or other product is gravity discharged from mixer 10 through this opening 44 into an awaiting receptacle (not shown), for subsequent transport to the point of use.

Inlet openings 30A, 32A (respectively) of chutes 30 and 32 are better seen in FIG. 3. Bulk solids are easily loaded into the hopper through these openings.

As seen in FIG. 4, housing 46 is split longitudinally into two sections 46A and 46B. Upper section 46A may be lifted from lower section 46B, so that the inner surfaces of housing 46 and auger 14 can be readily cleaned, as by a garden hose (not shown), or for access to mixing auger 14, as for service. Alternatively, upper section 46A may be hinged to lower section 46B, to avoid lifting and to secure upper section 46A permanently to mixer 10. Permanent connection prevents loss due to careless misplacement, theft, and the like.

To use mixer 10 for mixing concrete, mortar, cement, and similar materials, a suitable source of clean water (not shown), such as a garden hose, is connected to water control or metering device 42. Hopper 28 is charged with appropriate materials. Engine 20 is started, and runs continuously. When engine 20 is started, sprockets 22 and chain 24 drive main auger 14. In turn, pulley 36A drives pulley 36B by belt 35. Connection of pulley 36B to the shaft of feed auger 34 thus operates feed auger 34 simultaneously, and at a predetermined operating speed ratio with, main auger 14.

The mixing process starts, and may continue until the demand for the mixed product is satisfied. Hopper is refilled as required, and operation need not be interrupted. When sufficient product has been mixed, engine 20 is shut off. Preferably, housing 46 is opened and cleaned, and mixer 10 is substantially ready for transporting to the next job.

Thus, a compact, portable mixer is described, which mixer operates continuously, prepares small batches, and produces little waste.

It will be apparent to those of skill in the art that the present invention is susceptible to modifications and variations. For example, sprockets 22 and chain 24 may be replaced by pulleys and belt (not shown). Of course, pulleys 36A, 36B and belt 35 could be replaced by sprockets and chain (not shown). Also, it would be possible to drive feed auger 34 from engine 20, and to drive mixer auger 14 in turn from feed auger 34.

In another example, internal combustion engine 20, although preferred since it may be operated independently of connection to its environment, may be replaced by an electric motor or other motor (not shown). In some cases, quietness of operation may be more desirable than independence with respect to external connections. Also, in cases wherein mixer 10 is to be operated over long periods of time, it may prove more economical to employ utility electric power than it would be to operate on a liquid fuel such as gasoline. An example is seen in a small scale casting operations for fabricating preformed concrete pads, barriers, garden sculptures, and the like.

Another possible modification is that the arrangement of engine 20 and its chain and sprocket drive may be modified to also drive feed auger 34. Illustratively, engine 20 may be located proximate feed auger 34, with the shaft of feed auger 34 extending outside its associated chute 30, so that sprockets 22 and chain 24 may be located on the same side, with respect to front and rear, of mixer 10 as chute 30. This has the effect of rendering the belt and pulley drive unnecessary.

In another example of a modified drive, a third sprocket (not shown) may engage chain 24 and drive feed auger 34 by a shaft (not shown) extending between the third sprocket and auger 34. Still other drive arrangements may be provided to render the overall apparatus more economical and practical to operate and service.

As illustrated in FIG. 1, mixer 10 is provided with wheels 60 and trailer attachment hitch 52. Other methods of transport may be accommodated. For example, mixer 10 may be provided with a frame (not shown) fitting in tongue and groove fashion to a complementing frame formed in a truck or other motor vehicle (not shown). Such an arrangement would enable ready transport by the motor vehicle while still enabling mixer 10 to be removed therefrom and left at a jobsite.

It is to be understood that the present invention is not limited to the embodiments described above, but encompasses any and all embodiments within the scope of the following claims.

I claim:

1. A portable continual mixer for mixing dry, granular or powdered material with a liquid, comprising:

a feed auger for feeding the powdered material;

a mixing chamber comprising a housing and a mixing auger disposed within said housing, said mixing auger disposed in communication with said feed auger to receive powdered material from said feed auger, said mixing auger including a blade having a first section having a continuous screw blade arranged at a pitch, a second section having paddles arranged at a second pitch urging powdered material and liquid to migrate in the same direction as urged by said first section, said mixture blade further having a third section disposed after said first section and said second section, said third section characterized by a second continuous screw blade having a third pitch urging the powdered material and liquid to move in the same direction as urged by said first blade section and said second blade section; and drive means for driving said feed auger and said mixing auger, said drive means comprising a single motor and means for drivingly connecting said feed auger and said mixing auger to said single motor.

2. The portable continual mixer according to claim 1, said housing of said mixing chamber being of construction split longitudinally, said housing having an upper section and a lower section, said upper section being movable with respect to said lower section, whereby access into said mixing chamber for cleaning and service is provided.

3. The portable continual mixer according to claim 1, further comprising means for conducting a liquid into said mixing chamber, and a liquid metering device controlling liquid being introduced to said mixing chamber.

4. The portable continual mixer according to claim 1, further comprising a first chute for accepting powdered material fed by said feed auger, and discharging the powdered material to said mixing chamber; and a second chute for feeding a second powdered material by gravity to said mixing chamber, said first chute and said second chute located above said mixing chamber.

5. The portable continual mixer according to claim 1, said motor comprising a single cylinder internal combustion engine.

6. The portable continual mixer according to claim 1, said housing having a constant diameter.

7. The portable continual mixer according to claim 1, said single motor drivingly connected to said mixing auger, and said drive means including a first pulley connected to said shaft of said mixing auger and a pulley connected to said shaft of said feed auger, and a belt connecting said first pulley and said second pulley.

8. A portable continual mixer for mixing dry, granular or powdered material with a liquid, comprising:

a feed auger for feeding the powdered material;

a mixing chamber comprising a housing being of construction split longitudinally, said housing having an upper section and a lower section, said upper section being movable with respect to said lower section, whereby access into said mixing chamber for cleaning and service is provided, and a mixing auger disposed within said housing, said mixing auger disposed in communication with said feed auger to receive powdered material from said feed auger, said mixing auger including a blade having a first section having a continuous screw blade arranged at a pitch, a second section having paddles arranged at a second pitch urging powdered material and liquid to migrate in the same direction as urged by said first section, said mixture blade further having a third section disposed after said first section and said second section, said third section characterized by a second continuous screw blade having a third pitch urging the powdered material and liquid to move in the same direction as urged by said first blade section and said second blade section;

a first chute for accepting powdered material fed by said feed auger, and discharging the powdered material to said mixing chamber and a second chute for feeding a second powdered material by gravity to said mixing chamber, said first chute and said second chute located above said mixing chamber;

means for conducting a liquid into said mixing chamber and a liquid metering device controlling liquid being conducted to said mixing chamber; and drive means for driving said feed auger and said mixing auger, said drive means comprising a single motor and means for drivingly connecting said feed auger and said mixing auger to said single motor, said single motor drivingly connected to said mixing auger, and said drive means including a first pulley connected to said shaft of said mixing auger and a pulley connected to said shaft of said feed auger, and a belt connecting said first pulley and said second pulley.

9. The portable continual mixer according to claim 8, said motor comprising a single cylinder internal combustion engine.

* * * * *